United States Patent [19]

Shimizu et al.

[11] 4,098,580

[45] Jul. 4, 1978

[54] CANISTER FOR CATALYST CONVERTER AND MANUFACTURING PROCESS THEREFOR

[75] Inventors: Shigeru Shimizu, Toyota; Hiroki Yamauchi, Kariya, both of Japan

[73] Assignee: Toyota Jidosha Kogyo Kabushiki Kaisha, Japan

[21] Appl. No.: 753,826

[22] Filed: Dec. 23, 1976

[30] Foreign Application Priority Data

Jun. 10, 1976 [JP] Japan ..... 51-668066

[51] Int. Cl.[2] ..... B01J 8/02; F01N 3/15

[52] U.S. Cl. ..... 23/288 F; 55/518; 55/DIG. 30; 55/DIG. 37; 261/DIG. 72

[58] Field of Search ..... 23/288 F, 288 FA, 288 FB; 55/DIG. 30, DIG. 37, DIG. 41, 494, 518; 52/675; 181/50, 258; 261/DIG. 72

[56] References Cited

U.S. PATENT DOCUMENTS

| | | | |
|---|---|---|---|
| 1,215,235 | 2/1917 | Atwood | 52/675 |
| 1,306,339 | 6/1919 | Kass | 52/675 |
| 3,068,079 | 12/1962 | Purse et al. | 23/288 F |
| 3,695,850 | 10/1972 | Perga et al. | 23/288 F |
| 3,719,457 | 3/1973 | Nagamatsu | 23/288 F |
| 3,818,667 | 6/1974 | Wagner | 23/288 F X |
| 3,927,984 | 12/1975 | Hartley | 23/288 F |

FOREIGN PATENT DOCUMENTS

| | | | |
|---|---|---|---|
| 1,371,330 | 10/1974 | United Kingdom | 23/288 F |

*Primary Examiner*—Morris O. Wolk
*Assistant Examiner*—Michael S. Marcus
*Attorney, Agent, or Firm*—Oblon, Fisher, Spivak, McClelland & Maier

[57] ABSTRACT

A canister and the manufacturing process therefor, for a catalyst converter for prevention of attrition of the catalyst by rounding of the inside corners of the gas inlet and outlet in the canister holding a pellet catalyst.

4 Claims, 8 Drawing Figures

CANISTER FOR CATALYST CONVERTER AND MANUFACTURING PROCESS THEREFOR

BACKGROUND OF THE INVENTION

1. Field of the Invention

The present invention relates to a canister of a catalyst converter for vehicles provided for prevention of catalyst attrition and the manufacturing process therefor 2 Description of the Prior Art Catalyst converters are often now incorporated in the exhaust gas system of automobiles to eliminate the harmful elements of the exhaust gas. Commonly such a catalyst converter consists of a heat-insulated vessel housing a canister for the catalyst converter and the canister represents a molded vessel with numerous gas inlets and outlets which hold the catalyst to react with the harmful elements in the exhaust gas. The gas inlets and outlets have conventionally been formed by punching or louvre working. Thus a flashing is inevitably left around these inlets and outlets as the result of punching or louvre working. Such a flashing under the combined effects of vehicle vibration, engine vibration and gas stream vibration during running causes the catalyst in contact therewith to wear, resulting in attrition of the catalyst in the catalyst converter due to the worn pieces of the catalyst being carried away in the gas stream. Furthermore, the worn pieces of the catalyst clog the gas inlets and outlets, thereby leading to a rise in the engine exhaust pressure and finally to a drop in the engine performance.

SUMMARY OF THE INVENTION

The primary object of the present invention is to provide a canister for a catalyst converter, wherein the attrition of the catalyst can be prevented.

Another object of the present invention is to provide a canister for a catalyst converter, wherein the gas inlets and outlets are structurally free from clogging with catalyst pieces.

Still another object of the present invention is to provide a manufacturing process of a canister for a catalyst converter which causes no attrition of the catalyst held therein.

Still another object of the present invention is to provide a plastic working process to bore gas inlets and outlets and give roundness to them for prevention of catalyst wear.

BRIEF DESCRIPTION OF THE DRAWINGS

The objects and features of the invention will become apparent to those skilled in the art as the disclosure is made in the following description of a preferred embodiment of the invention, as illustrated in the accompanying drawings, in which.

DESCRIPTION OF THE PREFERRED EMBODIMENTS

Figure 1:
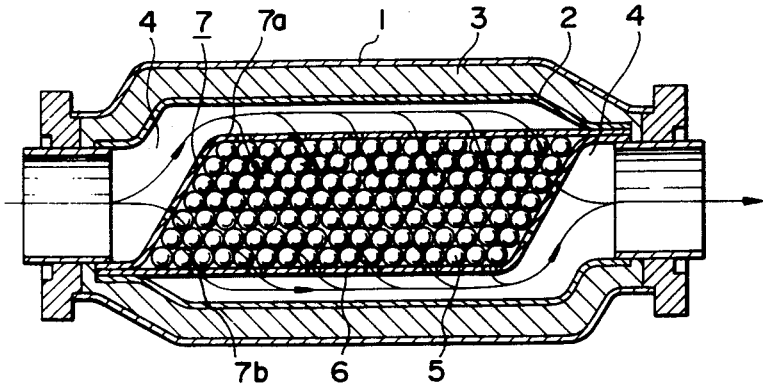
FIG. 1 is a whole sectional view of a catalyst converter containing a canister according to the present invention.

In FIG. 1 which shows a section of a whole catalyst converter, an exhaust gas passage 4 is formed within the heat-insulated casing of doublewalled structure including an outer case 1 and an inner case with the heat insulator 3 inserted therebetween. The exhaust gas passage 4 holds a canister 6 for the catalyst converter which contains a catalyst 5. The catalyst 5 consists of pellets of effective materials to react with the harmful elements in the exhaust gas, i.e., carbon monoxide, hydrocarbons, nitrogen oxides etc., such as alumina, platinum, palladium etc. The canister 6 is usually fabricated of metal and provided with numerous openings 7 so that the exhaust gas can flow therethrough. Those of the openings 7 which are located upstream of the gas flow constitute the gas inlets 7*a* to the catalyst 5, while those which are located downstream constitute the gas outlets 7*b*.

Figure 2:
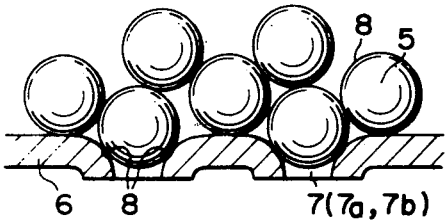
FIG. 2 is an enlarged sectional view of the vicinity of the gas inlet or outlet in the canister shown in FIG. 1.

In FIG. 2 which is an enlarged view of the vicinity of the gas inlet 7*a* and outlet 7*b* in the canister, the inside corner of the canister 6 around its opening 7 is rounded as at 8 so that contact with the catalyst 5 can be smooth. The roundness 8 is provided by plastic working as described later. The roundness 8 may have any radius of curvature so long as the wearing of the catalyst 5 can be prevented, but from the standpoints of wear prevention and ease of manufacture it would be desirable to have a radius of curvature greater than about 0.5 times the plate thickness of the canister; although obviously the value may be set at less than 0.5 times.

Figure 3:
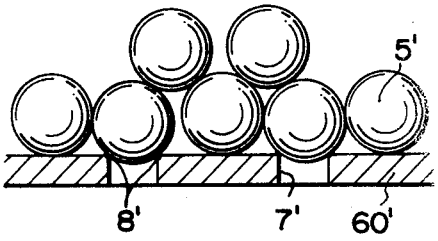
FIG. 3 Prior Art
FIG. 3 is a sectional view showing the vicinity of the gas inlet or outlet in a conventional canister for a catalyst converter.

The roundness 8 given to the opening 7 would prevent the catalyst 5 from suffering attrition even when a vibration occurs at the contact point between the catalyst 5 and the opening 7 in the canister 6 under vibration of the vehicle. FIG. 3 illustrates the state of contact between a catalyst 5′ and a non-rounded opening 7′ in a conventional canister 60′. It can be seen in contrast to FIG. 2 how the wearing of catalyst pellets is aggravated by the flashed or sharp-edged opening 8′.

Figure 4:
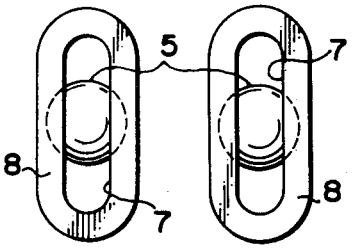
FIG. 4 is a plan view of the gas inlet or outlet of FIG. 2 when it is formed as an oval opening.

The opening 7 for the gas inlet 7*a* or the gas outlet 7*b* may be shaped in an arbitrary form. In FIG. 4 the rounded opening 7 is shaped in an oval form, whereby the clogging of the canister 6 as the result of the catalyst falling into and filling the opening 7 can be prevented when the catalyst 5 used is in spherical pellet form. Thus the opening 7 is structurally free from the possibility of being clogged with the catalyst 5.

Next, description is to be made of the manufacture of the catalyst converter according to the above embodiment, and more particularly as to the boring of the opening 7 in the canister 6.

Figure 5:
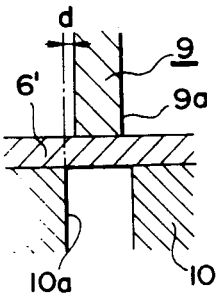
FIGS. 5 and 6 are sectional views of the canister for the catalyst converter according to the present invention when the gas inlets and outlets are formed in two steps.
Figure 6:
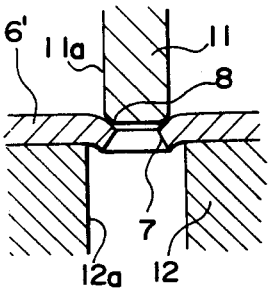

In FIGS. 5 and 6, the material 6′ for the canister is molded to an appropriate form to hold the catalyst; then it is bored with openings 7; thereafter the inside corner of the canister material around the openings 7 is rounded 8 by plastic working; and finally the canister 7 thus constructed is filled with the catalyst 5. The openings 7 may be formed by punching or louvre working. FIG. 5 illustrated a case of punching, wherein the metallic canister material 6' is placed between a punch 9 and die 10; and the opening 7 is bored by the shearing faces constituted of an outer surface 9*a* of the punch 9 and an inner surface 10*a* of the die 10. To ensure good working by this shear punching, it is desirable that the clearance *d* between the shearing faces 9*a*, 10*a* be 0.03 to 0.06 times the plate thickness of the canister 6. Next, as shown in FIG. 6, the canister material 6' with the openings bored therein is placed on a die 12 with a hole 12*a* of larger inner diameter than the hole 10*a* of the die and, using a punch 11 with a larger diameter 11*a* than the opening 7, the edge of the opening 7 is formed by plastic deformation to the roundness 8.

Figure 7:
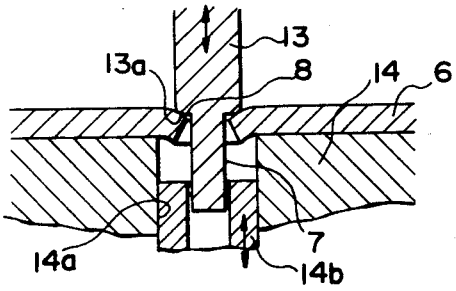
FIG. 7 is a sectional view of a device which combines the functions of the devices shown in FIGS. 5 and 6.

In FIG. 7, by the process illustrated in FIGS. 5 and 6 using a punch 13 with a shoulder 13*a* and a die 14 variable in the inner diameter 14*a*, two steps of boring a hole 7 and giving roundness 8 can be finished in one rise-fall stroke of the punch 13. Thereby, in the boring step a die inner diameter adjust tool 14*b* is at an upper limit position, while in the roundness-giving step it is at a lower limit position.

Figure 8:
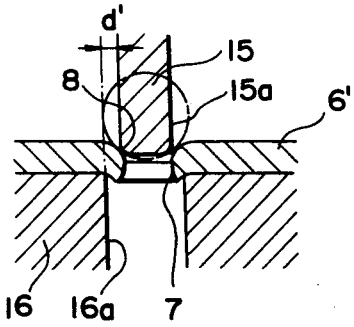
FIG. 8 is a sectional view of the canister for the catalyst converter manufactured by another process according to the present invention in which the gas inlet and outlet are formed in one step.

In FIG. 8 is illustrated the method of forming the opening 7 with a roundness 8 by another process. In this method the canister material 6' is routinely molded to a suitable form with a specified cavity to house the catalyst 5. Next, with the clearance *d'* between the shearing faces constituted of an outer surface 15*a* of a punch 15 and an inner surface 16*a* of a die 16 appropriately set at over 0.06 times the plate thickness of the canister material 6', the canister material 6' is placed between the punch 15 and the die 14; and by applying the punch 15 in the direction of the die 16, the boring of the opening 7 and its rounding 8 are finished in one step by shear punching and plastic bending. Thus as compared with the method described in FIGS. 5 and 6 which involves two steps, the method described in FIG. 8 is completed in one step with an increased work efficiency and a lower cost. The canister 6 manufactured either by the method of FIGS. 5 and 6 or by the method of FIGS. 7 and 8 is filled with the pellet catalyst 5, thereby completing a canister for the catalyst converter.

In the method described above for manufacturing the canister 6, the molding of the canister to a form suitable for holding the catalyst precedes the boring and louvre working of the canister material 6', but this sequence may be reversed.

Therefore, when a catalyst converter housing the canister of this invention is employed, the attrition of the catalyst can be prevented and a high performance of the exhaust gas purification can be maintained. When the opening of the gas inlet or outlet in the canister is elongated, the canister for the catalyst converter can be free from clogging, from a rise in the back pressure due to clogging and from a drop in engine performance. Furthermore, according to the method of this invention, a catalyst converter of the above construction can be simply manufactured; and particularly when the clearance between the shearing faces of the punch and the die is set at more than 0.06 times the plate thickness of the canister, the roundness can be given in one step of punching, thereby increasing the work efficiency.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A canister for a catalyst converter which comprises opposing upstream and downstream plate members defining said canister;

gas inlets and outlets provided as numerous openings in said upstream and downstream plate members, respectively, with rounded portions given by plastic deformation of the inside edge of said openings such that said rounded portions of said opposing plate members face each other; and a pellet catalyst housed in said canister such that said rounded portions of said opposing plate members contact said pellet catalyst.

2. A canister for a catalyst converter according to claim 1, wherein the cross-sectional flow areas of said gas inlet and outlet openings are elongated.

3. A canister for a catalyst converter according to claim 1, wherein said canister further comprises an outer housing having a double wall structure with heat insulating means therebetween and inlet and outlet means for exhaust gases, said housing, said opposing upstream and downstream plate members and said housing inlet and outlet means respectively forming inlet and outlet plenums for conveying said exhaust gases to and from said canister.

4. A canister for a catalyst converter according to claim 1, wherein the radius of curvature of said rounded portions is greater than 0.5 times the thickness of said opposing plate members.

* * * * *